US010584474B2

(12) United States Patent
Grantham

(10) Patent No.: US 10,584,474 B2
(45) Date of Patent: Mar. 10, 2020

(54) SEPTIC SENSOR SPRAYER

(71) Applicant: Raymond Grantham, Ridgefield, WA (US)

(72) Inventor: Raymond Grantham, Ridgefield, WA (US)

( * ) Notice: Subject to any disclaimer, the term of this patent is extended or adjusted under 35 U.S.C. 154(b) by 112 days.

(21) Appl. No.: 15/822,223

(22) Filed: Nov. 27, 2017

(65) Prior Publication Data

US 2019/0161955 A1 May 30, 2019

(51) Int. Cl.

| | |
|---|---|
| ***E03F 9/00*** | (2006.01) |
| ***B05B 1/14*** | (2006.01) |
| ***B05B 3/04*** | (2006.01) |
| ***B05B 15/656*** | (2018.01) |
| ***B63B 29/14*** | (2006.01) |
| ***A47K 11/00*** | (2006.01) |
| ***B05B 9/01*** | (2006.01) |
| *B05B 13/06* | (2006.01) |
| *B05B 3/06* | (2006.01) |

(52) U.S. Cl.

CPC ..... *E03F 9/007* (2013.01); *A47K 11/00* (2013.01); *B05B 1/14* (2013.01); *B05B 3/0418* (2013.01); *B05B 3/0422* (2013.01); *B05B 3/0427* (2013.01); *B05B 9/01* (2013.01); *B05B 15/656* (2018.02); *B63B 29/14* (2013.01); *B05B 3/06* (2013.01); *B05B 13/0636* (2013.01)

(58) Field of Classification Search

CPC ..... B05B 9/01; B05B 3/06; B05B 15/656; B05B 1/14; B05B 3/0427; B05B 3/0422; B05B 3/0418; B05B 13/0636; E03F 9/007; A47K 11/00; B63B 29/14

USPC ..... 239/251, 380, 381, 280, 281, 525, 532, 239/225.1, 255, 261; 134/167 R, 169 R, 134/168 R

See application file for complete search history.

(56) References Cited

U.S. PATENT DOCUMENTS

| | | | | |
|---|---|---|---|---|
| 3,125,297 | A * | 3/1964 | Copeland et al. | B05B 3/06 239/251 |
| 3,809,317 | A * | 5/1974 | Bender | B05B 3/0427 239/251 |
| 4,030,513 | A * | 6/1977 | McKenzie | B05B 3/06 239/251 |
| 5,316,218 | A * | 5/1994 | Bowen | B05B 13/0636 239/251 |
| 5,884,842 | A * | 3/1999 | Caine | B08B 9/093 239/251 |
| 7,963,462 | B1 * | 6/2011 | Ramos, Sr. | B05B 3/063 239/251 |
| 8,079,533 | B2 * | 12/2011 | Bowen | B05B 3/06 239/261 |
| 8,137,481 | B2 * | 3/2012 | Jensen | B05B 3/06 134/167 R |
| 2002/0174886 | A1 * | 11/2002 | Paper | B08B 9/093 134/169 R |

* cited by examiner

*Primary Examiner* — Steven J Ganey

(74) *Attorney, Agent, or Firm* — The Iwashko Law Firm, PLLC; Lev Ivan Gabriel Iwashko

(57) ABSTRACT

A septic sensor sprayer, including a rod, a hose attachment portion disposed at a first end of the rod to receive an external hose to be removably fixed thereto, such that the hose attachment portion receives water from the external hose, and a rotatable head disposed at a second end of the rod to rotate upon receipt of water from the rod.

5 Claims, 1 Drawing Sheet

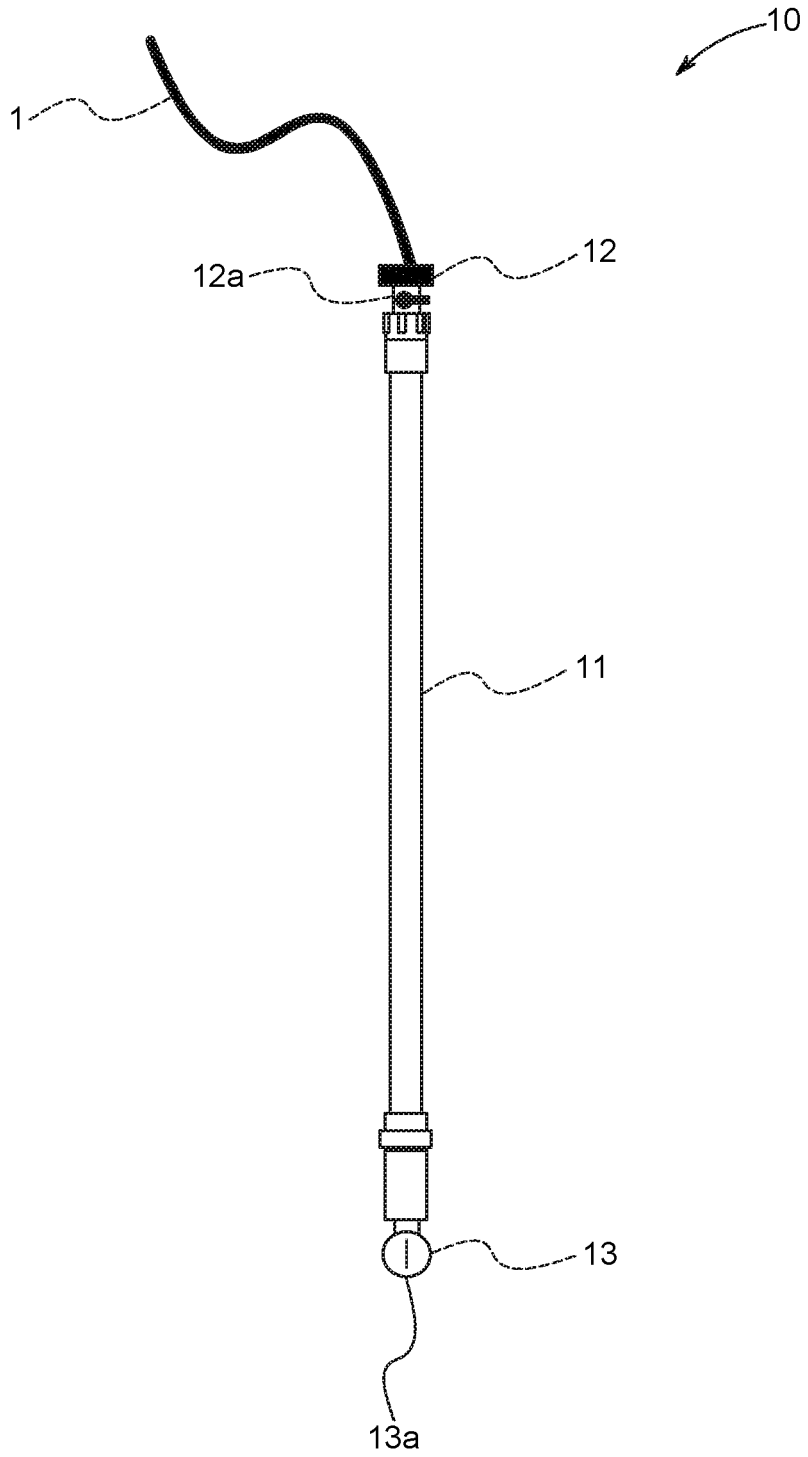
10
1
12
12a
11
13
13a

SEPTIC SENSOR SPRAYER

BACKGROUND OF THE INVENTION

1. Field of the Invention

The present general inventive concept relates generally to a septic sensor sprayer.

2. Description of the Related Art

Recreational Vehicles (RVs) and boats are often equipped with bathrooms including toilets. However, when a sewage (e.g., septic) tank of the RV or boat becomes filled with sewage over time, certain undesirable problems may arise. For example, conventional sewage tanks often include septic sensors that sense a level of sewage within the sewage tanks. As such, when a level of sewage reaches and covers the sensors, a panel outside the sewage tank indicates that the tank is full and requires emptying. However, these sensors often remain dirty even after the sewage tank is emptied, as human waste can often be sticky, thereby adhering to the sensors. As a result of the sensors being dirty, a user may be misinformed as to whether the sewage tank is full or empty.

A conventional solution to clean the septic sensors includes pouring special sewage-destroying chemicals into the sewage tank. However, these chemicals can often be dangerous and caustic to the environment, and therefore are often undesirable.

Other conventional solutions include inserting hoses into the sewage tanks to spray water therein, but these hoses are not easy to use and/or maneuver.

Therefore, in order to maintain accurate septic sensor readings within septic tanks, there is a need for a convenient method and device to clean sewage from the sensors within septic tanks.

SUMMARY

The present general inventive concept provides a septic sensor sprayer.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a septic sensor sprayer, including a rod, a hose attachment portion disposed at a first end of the rod to receive an external hose to be removably fixed thereto, such that the hose attachment portion receives water from the external hose, and a rotatable head disposed at a second end of the rod to rotate upon receipt of water from the rod.

The rod may be at least one of telescopic to vary in size and flexible to vary in shape.

The hose attachment portion may include a cutoff valve to control whether water flows from the hose attachment portion to the rod.

The rotatable head may include slits to allow the water to be expelled therefrom.

The slits may be positioned on the rotatable head to facilitate rotation of the rotatable head when the water is introduced into the rotatable head.

The water may be sprayed laterally from the slits of the rotatable head while the rotatable head rotates 360 degrees.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a septic sensor sprayer, according to an exemplary embodiment of the present general inventive concept.

DETAILED DESCRIPTION OF THE INVENTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

FIG. 1 illustrates a septic sensor sprayer 10, according to an exemplary embodiment of the present general inventive concept.

The septic sensor sprayer 10 may be mechanical and hand-held, or may be electrically-connected and installed within a septic tank to be controlled from a mobile device or a control panel outside the septic tank. In other words, if the septic sensor sprayer 10 has electrical capabilities and connections, then it may be attached within a septic tank to be controlled from a power source and a controller, such that the septic sensor sprayer 10 may mechanically and electrically move up and down within the septic tank such that the septic sensor sprayer 10 may clean a sensor within the septic tank.

Referring to FIG. 1, the septic sensor sprayer 10 may include a rod 11, a hose attachment portion 12, and a rotating head 13.

The septic sensor sprayer 10 and all components included therein and/or therewith may be made from metal, plastic, wood, silicone, or any other easily-cleanable material that may be submerged in water and/or sewage.

The rod 11 may be telescopic and flexible, to allow the rod 11 to vary in size and shape in order to be able to enter pipes and tanks of varying shapes and sizes. Also, the telescopic feature of the rod 11 allows for easy storage of the septic sensor sprayer 10.

The hose attachment portion 12 may be disposed at a first end of the rod 11, and may include an inner threading to allow an external hose 1 connected to a water supply to be attached and fixed thereto.

The hose attachment portion 12 may also include a cutoff valve 12*a* to allow a user to control whether water enters the septic sensor sprayer 10. More specifically, when the cutoff valve 12*a* is in an OFF position, even if water is flowing from the external hose 1, the septic sensor sprayer 10 does not receive the water. The user may rotate the cutoff valve 12*a* to an ON position to allow the water from the external hose 1 to enter the septic sensor sprayer 10 through the hose attachment portion 12.

The rotating head 13 may be rotatably disposed on another end of the rod 11. The rotating head 13 may include slits 13*a* to allow water to be sprayed out therefrom. More specifically, when water enters the septic sensor sprayer 10 at the hose attachment portion 12*a*, it may flow through the rod 11, and then out the slits 13*a*.

The slits 13*a* may have various shapes and sizes and positioning on the rotating head 13, such as circles, slits, and spirals, but are not limited thereto.

Also, the rotating head 13 may be designed to rotate such that pressure from the water causes the water to be sprayed out from the slits 13*a* and in effect provide a force that allows the rotating head 13 to rotate. More specifically, the slits 13*a* are positioned on the rotatable head 13 to facilitate rotation of the rotatable head 13 when the water is introduced into the rotatable head 13.

Therefore, when the rotating head 13 of the septic sensor sprayer 10 is inserted deep into a septic tank, an introduction of water from an external hose 1 at the hose attachment portion 12 causes water to flow through the rod 11 and then through the specially designed and positioned slits 13*a*, thereby using pressure from the received water to rotate the rotating head 13 in a 360-degree rotation, accordingly spraying water laterally 360-degrees in order to clean sewage off of sensors within the septic tank.

Alternatively, the septic sensor sprayer 10 may be factory-installed into septic tanks of recreational vehicles and boats. More specifically, the septic sensor sprayer 10 may be installed within the septic tanks of recreational vehicles and boats to be connected a tube connected to the septic tank, for example, and more specifically, to be connected to an end of the tube by a spring. There would also be a main water supply connection to another end of the tube. When the water supply is turned on, the water may flow from the another end of the tube to the end of the tube, and water pressure may push against the spring pressure to force the septic sensor sprayer 10 down into the septic tank. The spray head may then work automatically to clean the sensors and the interior of the tank in exactly the same manner as mentioned above with regard to FIG. 1. When the water is turned off, the spring may automatically withdraw the septic sensor sprayer 10 back into its housing tube.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A septic sensor sprayer installable within a septic tank having sensors, comprising:

a tube connectable to the septic tank having an end and another end;

a rod telescopically connected by a first end within the end of the tube by a spring;

a hose attachment portion disposed at the another end of the tube to receive an external hose to be removably fixed thereto, such that the hose attachment portion receives water from the external hose; such that when the water is turned on the water will flow through the tube and the rod and water pressure may push against the spring to force the rod down into the septic tank; and a rotatable head disposed at a second end of the rod to rotate upon receipt of water from the rod, such that the rotatable head comprises slits to allow the water to be expelled therefrom in various directions to clean the inside of the septic tank and the sensors, such that the spring may automatically withdraw the rod back into the tube in response to the water being turned off.

2. The septic sensor sprayer of claim 1, wherein the rod is flexible to vary in shape.

3. The septic sensor sprayer of claim 1, wherein the hose attachment portion comprises a cutoff valve to control whether water flows from the hose attachment portion to the rod.

4. The septic sensor sprayer of claim 1, wherein the slits are positioned on the rotatable head to facilitate rotation of the rotatable head when the water is introduced into the rotatable head.

5. The septic sensor sprayer of claim 1, wherein the water is sprayed laterally from the slits of the rotatable head while the rotatable head rotates 360 degrees.

* * * * *